US007652428B2

(12) United States Patent
Hwang et al.

(10) Patent No.: US 7,652,428 B2
(45) Date of Patent: Jan. 26, 2010

(54) PLASMA DISPLAY APPARATUS AND MANUFACTURING METHOD OF THE SAME

(75) Inventors: Yong-Shik Hwang, Suwon-si (KR); Won-Ju Yi, Suwon-si (KR); Kyoung-Doo Kang, Suwon-si (KR); Jae-Ik Kwon, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 291 days.

(21) Appl. No.: 11/860,448

(22) Filed: Sep. 24, 2007

(65) Prior Publication Data

US 2008/0100217 A1 May 1, 2008

(30) Foreign Application Priority Data

Nov. 1, 2006 (KR) ..... 10-2006-0106997

(51) Int. Cl.
*H01J 17/49* (2006.01)

(52) U.S. Cl. ..... 313/586; 445/24

(58) Field of Classification Search ..... 313/582–586; 445/24

See application file for complete search history.

(56) References Cited

U.S. PATENT DOCUMENTS

| | | | | |
|---|---|---|---|---|
| 5,053,673 | A * | 10/1991 | Tomii et al. | 313/308 |
| 6,160,345 | A * | 12/2000 | Tanaka et al. | 313/489 |
| 6,373,191 | B1 | 4/2002 | Jang et al. | |
| 2004/0189199 | A1 * | 9/2004 | Komaki et al. | 313/582 |
| 2006/0164012 | A1 | 7/2006 | Kweon et al. | |
| 2007/0046206 | A1 * | 3/2007 | Kim et al. | 313/582 |

FOREIGN PATENT DOCUMENTS

| | | |
|---|---|---|
| EP | 1 467 396 A2 | 10/2004 |
| JP | 06-168669 | 6/1994 |
| JP | 8-15677 | 1/1996 |
| JP | 10-116556 | 5/1998 |
| JP | 2004-162087 | 6/2004 |

(Continued)

OTHER PUBLICATIONS

Patent Abstracts of Japan, Publication No. 08-015677, dated Jan. 19, 1999, in the name of Tomoya Yano.

(Continued)

*Primary Examiner*—Peter Macchiarolo
(74) *Attorney, Agent, or Firm*—Christie, Parker & Hale, LLP.

(57) ABSTRACT

A plasma display apparatus and manufacturing method. The plasma display apparatus includes a front substrate and a rear substrate. The rear substrate is formed of a metallic substance in which a plurality of grooves are formed on a surface facing the front substrate. An oxidation layer covers at least the surface facing the front substrate. A plurality of barrier ribs are located between the front and rear substrates and define a plurality of discharge cells corresponding to the grooves of the rear substrate. A plurality of discharge electrodes are located in the barrier ribs, surround at least portions of the discharge cells, and are separated from one another. A plurality of fluorescent substances are located in the grooves of the rear substrate. A discharge gas is filled in the discharge cells.

14 Claims, 10 Drawing Sheets

FOREIGN PATENT DOCUMENTS

| | | |
|---|---|---|
| JP | 2005-222938 | 8/2005 |
| KR | 1999-0042897 | 6/1999 |
| KR | 10-2003-0039463 | 5/2003 |
| KR | 10-2004-0080373 | 9/2004 |

OTHER PUBLICATIONS

Patent Abstracts of Japan, Publication No. 2004-162087, dated Jun. 10, 2004, in the name of Hiroyuki Hoshi et al.

Korean Patent Abstracts, Publication No. 1999-0042897, dated Jun. 15, 1999, in the name of Hong Ju Ha, with English Abstract for Korean application corresponding to subject publication.

Korean Patent Abstracts, Publication No. 1020030039463 A, dated May 22, 2003, in the name of Sang Rae Cho et al.

Korean Patent Abstracts, Publication No. 1020040080373 A, dated Sep. 18, 2004, in the name of Kaoru Tomii.

European Search Report dated Feb. 28, 2008, for European Application 07118449.3, indicating relevance of references listed in this Information Disclosure Statement.

Patent Abstracts of Japan for Publication No. 06-168669; dated Jun. 14, 1994 in the name of Yoshifumi Amano.

Patent Abstracts of Japan for Publicastion No. 10-116556; dated May 6, 1998 in the name of Koji Matsunaga et al.

Patent Abstracts of Japan for Publication No. 2005-222938; dated Aug. 18, 2005 in the name of San Kuwan Lee et al.

* cited by examiner

PLASMA DISPLAY APPARATUS AND MANUFACTURING METHOD OF THE SAME

CROSS-REFERENCE TO RELATED PATENT APPLICATION

This application claims priority to and the benefit of Korean Patent Application No. 10-2006-0106997, filed on Nov. 1, 2006, in the Korean Intellectual Property Office, the entire content of which is incorporated herein by reference.

BACKGROUND OF THE INVENTION

1. Field of the Invention

The present invention relates to a plasma display apparatus which displays images using a gas discharge and a manufacturing method of the same, and more particularly, to a thin plasma display apparatus and its method of manufacturing.

2. Description of the Related Art

Flat panel display apparatuses such as plasma display apparatuses have large screens with superior characteristics in terms of high-definition, thin size, light weight, and a wide viewing angle. Also, plasma display apparatuses can be manufactured to have large-scale screens more easily in comparison with other flat-panel display apparatuses and thereby are regarded as large-scale flat-panel display apparatuses of the next generation.

FIG. 1 is an exploded perspective view of a conventional plasma display apparatus. The conventional plasma display apparatus includes a plasma display panel 30, which displays images using a gas discharge, and a plurality of driving circuit units 60, which drive the plasma display panel 30 through controlling signals. The plasma display panel 30 includes front and rear glass substrates 10, 20, a plurality of discharge cells (not shown) located between the front and rear glass substrates 10, 20 in which discharge is generated, and a plurality of discharge electrodes (not shown) which cross over one another at the discharge cells and cause the discharge to be generated in the discharge cells. The driving circuit units 60 include a plurality of circuit boards in which a plurality of driving integrated circuits (ICs) and a plurality of circuit elements are mounted in order to apply a driving signal to the discharge electrodes. The plasma display panel 30 and the driving circuit units 60 are mounted on and supported by a chassis base 50. Particularly, the front surface of the chassis base 50 supports the plasma display panel 30 and the rear surface of the chassis base 50 supports the driving circuit units 60.

The chassis base 50 having a supporting structure protects the plasma display panel 30, which is conventionally composed of a glass material, from external impact, and provides a surface on which the driving circuit units 60 can be mounted. The chassis base 50 is composed of an aluminum material having superior thermal conductivity and, thereby, rapidly spreads discharge heat generated by the plasma display panel 30 throughout its surface and dissipates the driving heat generated by a plurality of heat generating elements of the driving circuit units 60. Two-sided tapes 45, which provide adhesive means, and a heat-dissipation sheet 40, which facilitates conduction of heat, are included between the plasma display panel 30 and the chassis base 50.

The rear glass substrate 20 and the chassis base 50 are composed of different materials. The rear glass substrate 20 is composed of a glass material in order to provide an insulated discharge environment and the chassis base 50 is composed of an aluminum material, which has superior thermal conductivity for heat dissipation and is also appropriate for grounding. However, the conventional plasma display apparatus as described above requires components such as the two-sided tapes 45 and the heat-dissipation sheet 40 to combine the rear glass substrate 20 and the chassis base 50 structurally and thermally. Further, processes are required to press the rear glass substrate 20 and the chassis base 50 together to combine the two parts.

SUMMARY OF THE INVENTION

Embodiments of the present invention provide a plasma display apparatus, which can be manufactured to be thin and light due to fewer required components and can be manufactured at lower costs due to fewer required components and manufacturing processes, and a manufacturing method of the same.

According to an aspect of the present invention, there is provided a plasma display apparatus including a front substrate, a rear substrate formed from a metallic substance in which a plurality of grooves are formed on a surface facing the front substrate and an oxidation layer covered at least on the surface facing the front substrate, a plurality of barrier ribs which are located between the front and rear substrates, and define a plurality of discharge cells corresponding to the grooves of the rear substrate, a plurality of discharge electrodes which are located in the barrier ribs, extend surrounding at least portions of the discharge cells, and are separated from one another at predetermined intervals, a plurality of fluorescent substances located in the grooves of the rear substrate, and a discharge gas filled in the discharge cells.

According to another aspect of the present invention, there is provided a method of manufacturing a plasma display apparatus including preparing a front substrate, preparing a rear substrate, forming a plurality of barrier ribs in which discharge electrodes are buried by stacking dielectric sheets having electrode patterns on one another, and performing frit sealing in order to combine the front and rear substrates facing each other having the barrier ribs between the front and rear substrates. The preparing of the rear substrate includes preparing an aluminum plate as a main material of the rear substrate, forming photoresist masks which expose regions in which grooves are to be formed on one surface of the aluminum plate, forming the grooves by selectively etching the exposed surface of the aluminum plate, forming an anti-oxidation layer which covers the other surface of the aluminum plate, performing an anodizing process which forms an oxidation layer on the etched surface of the aluminum plate by oxidizing the aluminum plate, removing the anti-oxidation layer, and coating fluorescent substances in the grooves.

DETAILED DESCRIPTION

Figure 1:
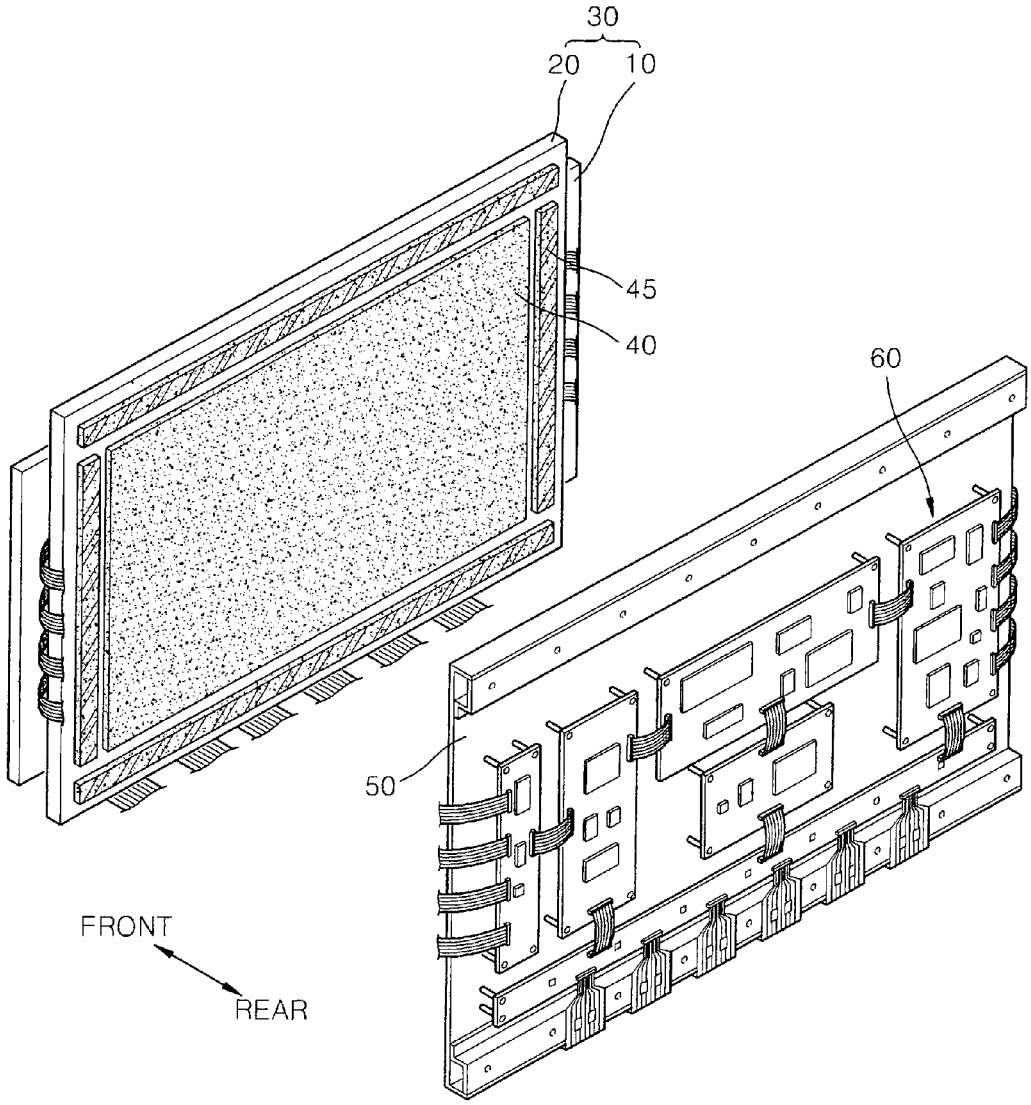
FIG. 1 (PRIOR ART)
FIG. 1 is an exploded perspective view of a conventional plasma display apparatus.
Figure 2:
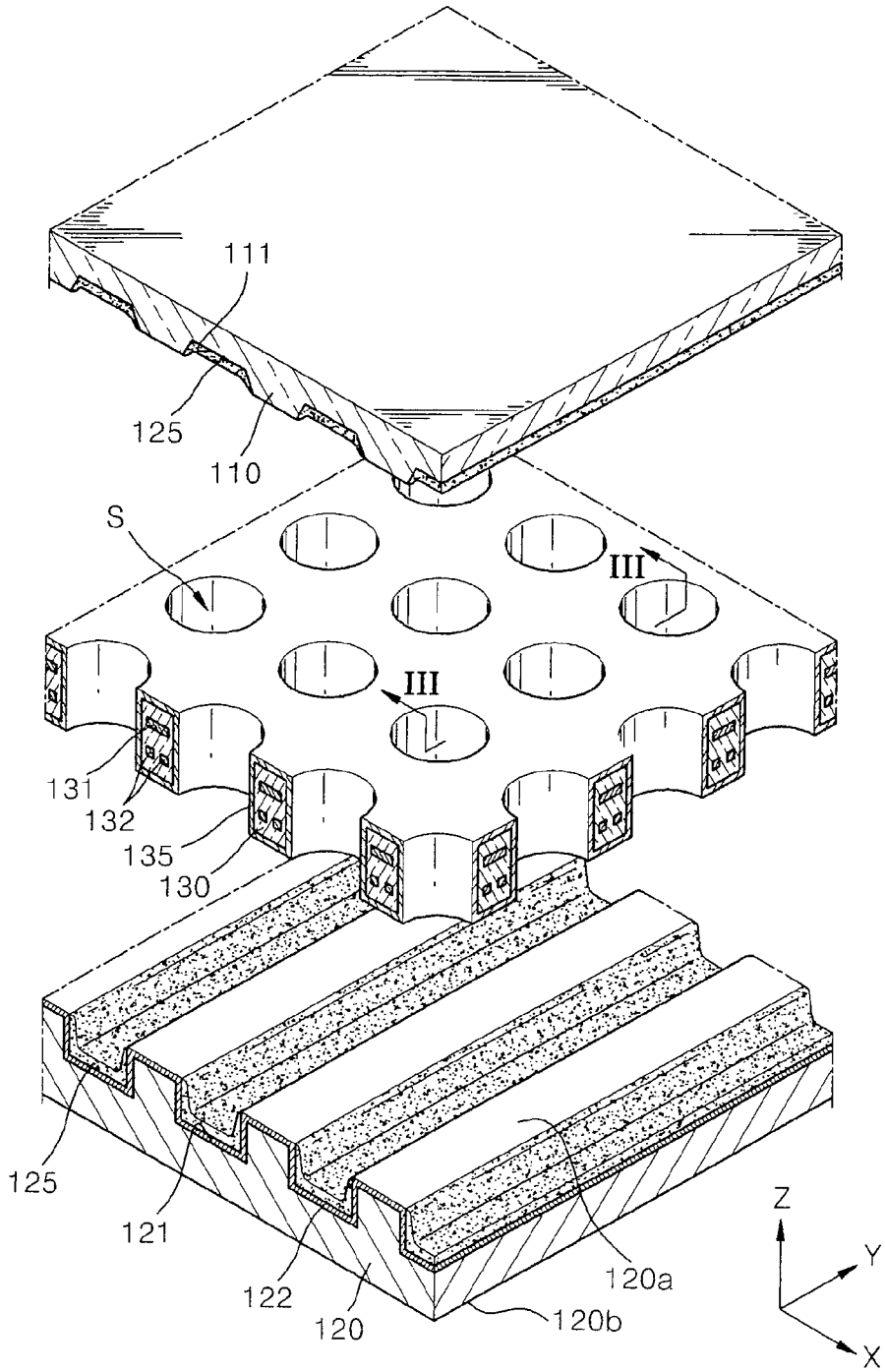
FIG. 2 is an exploded perspective view of a plasma display apparatus according to an embodiment of the present invention.
Figure 3:
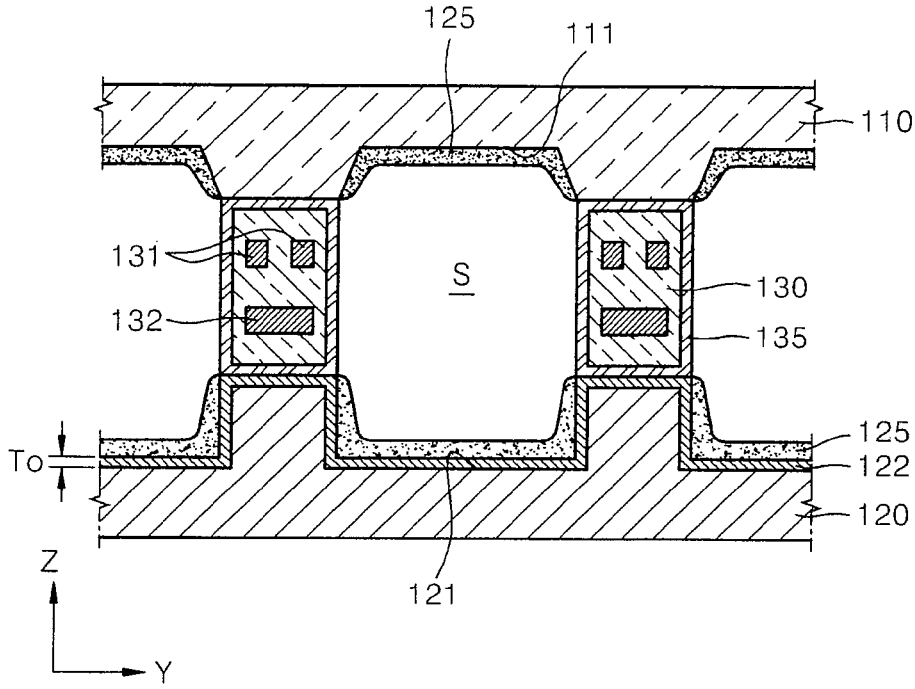
FIG. 3 is a longitudinal cross-sectional view of the plasma display apparatus cut along a line III-III of FIG. 2, according to an embodiment of the present invention.

FIG. 2 is an exploded perspective view of a plasma display apparatus according to an embodiment of the present invention. FIG. 3 is a longitudinal cross-sectional view of the plasma display apparatus cut along a line III-III of FIG. 2. The plasma display apparatus of the embodiments of the present invention may be a plasma display panel or may, alternatively, include components in addition to a plasma display panel.

Referring to FIGS. 2 and 3, the plasma display apparatus includes front and rear substrates 110, 120 located at predetermined intervals therebetween, and barrier ribs 130 which are located between the front and rear substrates 110, 120, and define a plurality of discharge cells S. The front substrate 110 may perform as a display screen through which a predetermined image is projected. For this, the front substrate 110 may be composed of a glass material having high transmittance. The barrier ribs 130 define the discharge cells S as independent emission regions. In the embodiment shown in FIGS. 2 and 3, the barrier ribs 130 define the discharge cells S with circular transverse cross-sections. However, the transverse cross-sections of the discharge cells S are not limited to the circular shapes. Hence, the transverse cross-sections of the discharge cells S can be polygonal shapes such as rectangles, pentagons and hexagons, or oval shapes by varying the shapes of the barrier ribs 130.

The barrier ribs 130 may be composed of a dielectric having a predetermined relative dielectric constant in order to provide sufficient withstanding voltage characteristics, thereby providing an advantageous environment for discharge. For example, the dielectric characteristic of the barrier ribs 130 induces an accumulation of wall charges and helps prevent first and second discharge electrodes 131, 132 from direct conduction during discharge. Additional protective layers 135 may cover the side walls of the barrier ribs 130 which directly contact the discharge cells S in order to prevent damage to the barrier ribs 130 from collision of charged particles. The protective layers 135 may be composed of, for example, a thin layer of MgO.

The first and second discharge electrodes 131, 132 are buried in the barrier ribs 130 and are located with a distance between them. The distance at which the first and second discharge electrodes 131, 132 are set apart, may be predetermined. The circular first and second discharge electrodes 131, 132 of the embodiment shown in FIGS. 2, 3 and 4, may form symmetrical electric fields in the discharge cells S with a central axis of each of the discharge cells S along a z-axis direction as a center of the electric field. The electric field may be stronger at the center and an excitation of a discharge gas by collision of charged particles may be promoted by focusing plasma into the center of each of the discharge cells S.

Figure 4:
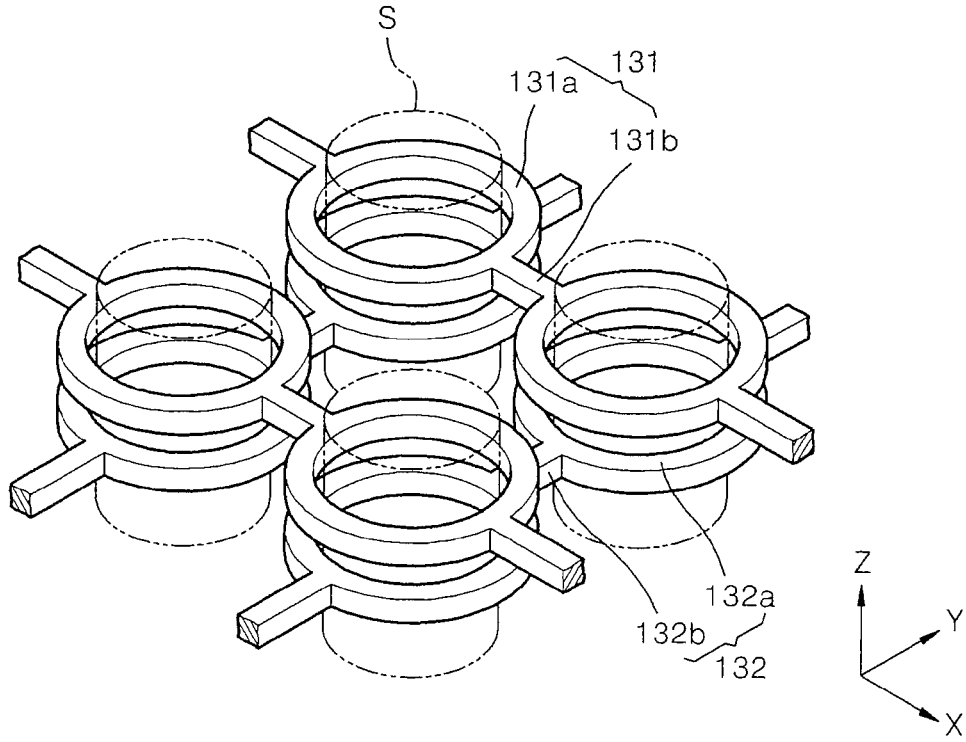
FIG. 4 is a perspective view illustrating a configuration of electrodes of the plasma display apparatus of FIG. 2, according to an embodiment of the present invention.

FIG. 4 is a perspective view illustrating a configuration of the first and second discharge electrodes 131, 132 of the plasma display apparatus of FIG. 2, according to an embodiment of the present invention. Referring to FIG. 4, the first discharge electrodes 131 surround the discharge cells S arranged in rows along an x-direction of the drawing. The first discharge electrodes 131 extend in the x-direction and are parallel to one another. Each of the first discharge electrodes 131 is separated from adjacent first discharge electrodes 131 and different electric signals are provided to each of the first discharge electrodes 131 through terminals connected to external sources. The first discharge electrodes 131 include discharge portions 131*a*, which directly participate in discharge, and conduction portions 131*b*, which electrically connect the adjacent discharge portions 131*a* to each other. The discharge portions 131*a* may be formed in a closed-loop structure, thereby entirely surrounding perimeters of the discharge cells S. However, an open-loop structure in which portions of the perimeters of the discharge cells S are open may also be possible as long as the discharge portions 131*a* can participate in forming electric fields and generating discharge in the discharge cells S. The conduction portions 131*b* are integrally formed with the adjacent discharge portions 131*a* such that the discharge portions 131*a* included in each of the first discharge electrodes 131 may share the same driving signal with each other. However, the discharge portions 131*a* may also share the same driving signal without the conduction portions 131*b*. Accordingly, in some embodiments, the conduction portions 131*b* are not included in the first discharge electrodes 131.

The second discharge electrodes 132 are separated from and located under the first discharge electrodes 131 along the z-axis of the drawing. The second discharge electrodes 132 have a structure similar to the structure of the first discharge electrodes 131. Therefore, the second discharge electrodes 132 include discharge portions 132*a*, which surround the discharge cells S, and conduction portions 132*b* which electrically connect the adjacent discharge portions 132*a* to each other. The second discharge electrodes 132 extend in a direction different from the first discharge electrodes 131. For example, the second discharge electrodes 132 may extend in a y-direction of the drawing, which crosses the direction of the first discharge electrodes 131 at a right angle. By extending the first and second discharge electrodes 131, 132 along intersecting directions, a passive matrix display is enabled. Specifically, the first and second discharge electrodes 131, 132 may function as address electrodes and scan electrodes and thereby, selective operation of the discharge cells S, in which a display discharge is generated, is enabled. For example, the first discharge electrodes 131 can perform as the address electrodes and the second discharge electrodes 132 can perform as the scan electrodes. The discharge portions 131*a*, 131*b* of the first and second discharge electrodes 131, 132 form electric fields in order to generate discharge in the discharge cells S.

The first and second discharge electrodes 131, 132 may be formed of electrically conductive substance such as Al, Cu, Ag having in order to prevent a voltage drop by resistance along the first and second discharge electrodes 131, 132. When an alternating voltage that is sufficient to generate discharge between the first and second discharge electrodes 131, 132 is applied, electric fields are formed in the discharge cells S according to the applied voltage and discharge is generated in the z-axis direction. The electric fields thus generated pass through the sidewalls of the barrier ribs 130 which define the discharge cells S. Application of a predetermined alternating voltage produces a predetermined electric field.

Referring back to FIGS. 2 and 3, the front and rear substrates 110, 120 prevent or retard leaking of a discharge gas filled in the discharge cells S and define the discharge cells S together with the barrier ribs 130. The rear substrate 120 includes a first surface 120*a* which is an upper surface of the rear substrate 120 and a second surface 120*b* which is a lower surface of the rear substrate 120. The rear substrate 120 is integrally formed by forming first grooves 121 as patterns in the first surface 120*a* of the rear substrate 120 that is a metal plate, and forming an oxidation layer 122 on the first surface 120*a* where the first grooves 121 are formed. The oxidation layer 122 is formed through an oxidizing process such anodizing and may have a predetermined thickness. The first grooves 121 formed on the rear substrate 120 may be formed in stripes located at predetermined intervals to correspond to the rows of the discharge cells S. The first grooves 121 define regions that are coated with fluorescent substances 125. The areas in between the first grooves 121 have a vertical dimension that is different from the vertical dimension of the first grooves 121 such that adjacent fluorescent substances 125 having different fluorescent colors are not mixed at in-between areas of the first grooves 121. Emission efficiency of the plasma display apparatus is improved by increasing the coating regions of the fluorescent substances 125 through the bottoms and sidewalls of the first grooves 121. For example, the different R, G and B fluorescent substances 125 are coated in the first grooves 121. Accordingly, the corresponding discharge cells S are formed as R, G and B subpixels which emit red, green and blue lights, respectively, and three adjacent R, G and B subpixels forms one pixel unit.

Second grooves 111 in which the fluorescent substances 125 are coated may be formed in the front substrate 110. The second grooves 111 may be formed in a striped pattern, with stripes which extend parallel to each other at predetermined intervals to correspond to the rows of the discharge cells S. The second grooves 111 provide regions in addition to the first grooves 121 of the rear substrate 120, in which the fluorescent substances 125 are coated. The additional regions for the fluorescent substances 125 provided by the second grooves 111 further improve emission efficiency. Specifically, by coating the fluorescent substances 125 on both top and bottom regions corresponding to the discharge cells S, ultraviolet rays generated by the discharge are prevented from being transmitted to the outside and being lost. Instead, the ultraviolet rays that would be otherwise lost, are transformed into visible rays which participate in the formation of the image by the plasma display. As a result, the emission efficiency of the plasma display apparatus is improved. To prevent color mixture, the second grooves 111 of the front substrate 110, are coated with fluorescent substances 125 of the same color as the fluorescent substances 125 coating the corresponding first grooves 121 of the rear substrate 120.

The rear substrate 120 according to one embodiment of the present invention is chassis-base-integrated to function as both a glass substrate and a chassis base. The rear substrate 120 may also function as a chassis base as described in detail with reference to FIG. 5.

Figure 5:
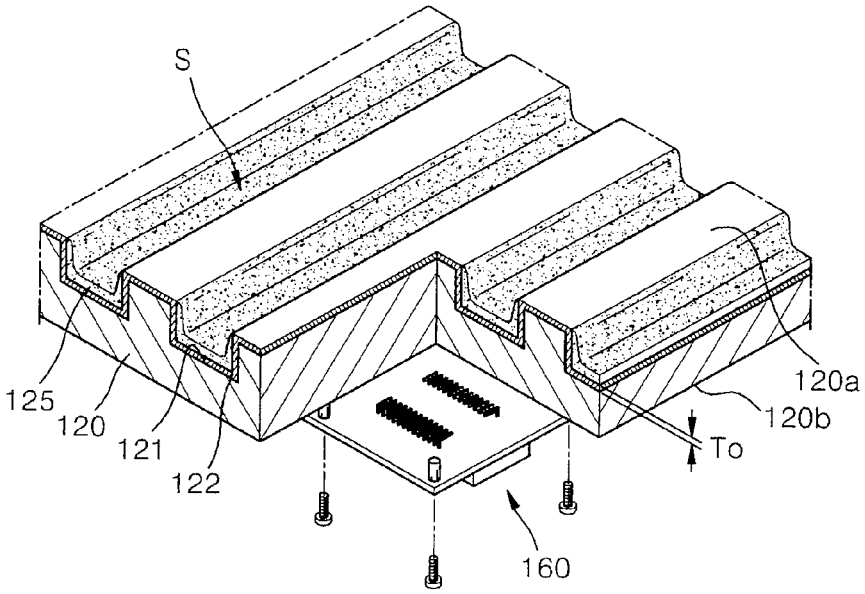
FIG. 5 is a perspective view of a rear substrate of the plasma display apparatus of FIG. 2, according to an embodiment of the present invention.

FIG. 5 is a perspective view of the rear substrate 120 of the plasma display apparatus of FIG. 2, according to an embodiment of the present invention. The rear substrate 120 directly or indirectly supports a plurality of other components of the plasma display apparatus. The first surface 120*a* of the rear substrate 120 supports the front substrate 110 and the barrier ribs 130 as shown in FIG. 2. The second surface 120*b* of the rear substrate 120 supports a driving circuit unit 160 and thereby providing a surface on which the driving circuit unit 160 is mounted. The driving circuit unit 160 generates driving signals and includes pluralities of driving integrated circuits (ICs) and circuit boards that apply the driving signals to the discharge electrodes 131, 132.

The rear substrate 120 may be formed of an aluminum plate, which provides sufficient rigidity as a supporting structure, and also has thermal and electrical conductivity for heat dissipation and grounding as described below.

When intensive heat is generated in some of the discharge cells S due to a large number of discharges occurring in these discharge cells S, the rear substrate 120 rapidly spreads the heat on its surface in order to prevent the heat from accumulating in some sectional regions. Moreover, the rear substrate 120 dissipates the heat into the air through the second surface 120*b* that is exposed to the outside air. The temperature of the ambient air is generally sufficiently low for the heat dissipation to occur. In addition to the heat generated by the discharge, the rear substrate 120 also dissipates heat generated by a plurality of heat generating elements included in the driving circuit unit 160 that is mounted on the second surface 120*b* of the rear substrate 120.

Furthermore, the rear substrate 120 that is formed of a metallic substance having good electrical conductivity may function as a ground region, which maintains a uniform ground voltage over a wide region. Accordingly, the driving ICs and circuit boards included in the driving circuit unit 160 may maintain a common ground voltage by directly being grounded to the rear substrate 120.

The oxidation layer 122 is formed on the first surface 120*a* of the rear substrate 120. The oxidation layer 122 covers regions of the first grooves 121 and regions in between the first grooves 121 with an approximately equal thickness To. In one embodiment, where the rear substrate 120 is made from aluminum, the oxidation layer 122 may be formed from Alumina ($Al_2O_3$), that is, an oxide of the main material of the aluminum plate of the rear substrate 120. The oxidation layer 122 may be formed through an anodizing process. The anodizing process is performed by an oxidation from the surface to the inside of the raw material. The thickness To of the oxidation layer 122 may be optimized by controlling the anodizing process conditions such as process time, applied current, and electrolytic solution. The thickness To of the oxidation layer 122 may be selected in a range of 1 μm-50 μm in consideration of voltages that are to be withstood. The oxidation layer 122 that is formed in several to several tens of μm may withstand a voltage that is sufficient for driving the plasma display apparatus due to its fine internal structure. For example, the oxidation layer 122 having a thickness of 20 μm can withstand approximately 500V without an insulation breakdown. The rear substrate 120 on which the oxidation layer 122 is formed provides an insulated discharge environment together with the front substrate 110 and the barrier ribs 130 that define the discharge cells S. In the present embodiment, the oxidation layer 122 forms an insulation boundary layer between the discharge cells S and the rear substrate 120 and thereby prevents the electrically conductive plate of the rear substrate 120 from being directly exposed to the discharge cells S and affecting the discharge environment.

As described above, the oxidation layer 122 having a thickness To may be formed by an oxidizing process on the first surface 120*a* of the rear substrate 120, which contacts the discharge cells S directly. However, other parts of the rear substrate 120 may not need to be electrically insulated. For example the second surface 120*b*, which is exposed to the external air, does not have to be electrically insulated. Not forming the oxidation layer 122 on the second surface 120*b* of the rear substrate 120 maintains the high thermal and electrical conductivity of this surface and favors heat dissipation and grounding considerations. On the other hand, the general affinity between oxygen and a conductive metal, such as aluminum, or durability consideration for a plate, favor forming an additional oxidation layer (not shown) on the second surface 120*b* of the rear substrate 120 by an artificial anodizing process or by exposing the second surface 120*b* to air. In various embodiments, the oxidation layer 122 formed on the first surface 120*a* and an oxidation layer formed on the second surface 120*b* may have different thicknesses due to different purposes of the oxidation layer 122 formed on the first surface 120*a* and the oxidation layer formed on the second surface 120*b*.

Generally, in an oxidation (or oxidizing) process such as anodizing, all exposed surfaces of an element to be processed are oxidized in a tub of electrolytic solution. Therefore, if only the first surface 120*a* of the rear substrate 120 has to be oxidized and the second surface 120*b* of the rear substrate 120 does not have to be oxidized, the second surface 120*b* has to be covered with an anti-oxidation layer (not shown) such that oxygen is not able to permeate the second surface 120*b*. Alternatively, the oxidation layer 122 of the first surface 120*a* and the oxidation layer of the second surface 120*b* can be formed with different thicknesses by covering one of layers with an oxidation-delay layer in order to control the speed of oxidation. For example, the second surface 120*b* may be covered with the oxidation-delay layer to yield a thinner oxidation layer on the second surface of the rear substrate 120.

In a plasma display apparatus according to embodiments of the present invention, a chassis-base-integrated rear substrate functions both as a glass substrate and a chassis base at the same time. The integrated rear substrate is obtained by forming the rear substrate using a substance such as aluminum that is thermally and electrically conductive, and forming an oxidation layer on a surface of the rear substrate. Accordingly, thin and light plasma display apparatuses may be manufactured that require fewer components and fewer manufacturing processes and are, therefore, manufactured at lower costs.

FIGS. 6A through 6J are longitudinal cross-sectional views of a method of manufacturing the rear substrate 120 of FIG. 5 according to an embodiment of the present invention.

Figure 6A:
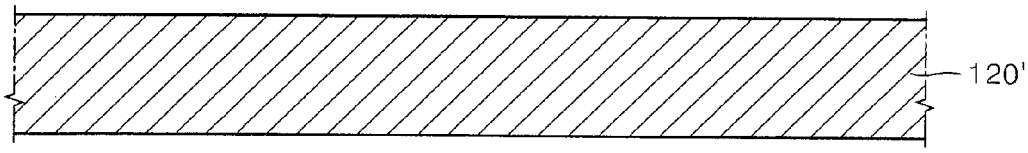
FIGS. 6A through 6J are longitudinal cross-sectional views of a method of manufacturing the plasma display apparatus of FIG. 2 according to an embodiment of the present invention.

First, referring to FIG. 6A, a metal plate for the rear substrate 120 of FIG. 5, is prepared. For example, an aluminum plate 120', which is conductive and capable of being oxidized due to affinity with oxygen may be prepared.

Figure 6B:
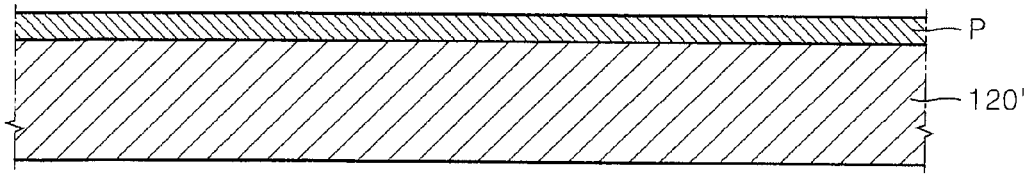

Then, referring to FIG. 6B, a photoresist P is coated on one surface of the aluminum plate 120'. The photoresist P may be formed of a photosensitive resin that is to be hardened through a chemical reaction when exposed to irradiated light such as ultraviolet rays.

Figure 6C:
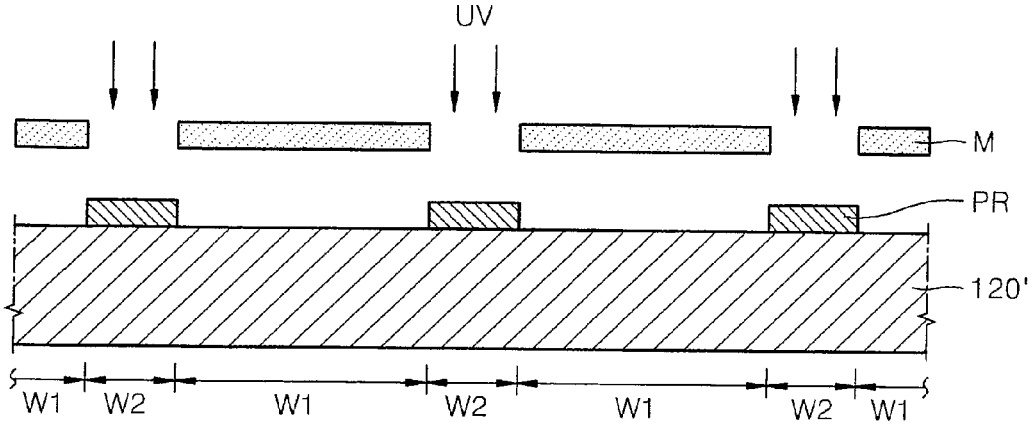

Then, referring to FIG. 6C, photoresist masks PR having predetermined patterns are formed by an exposure process in which ultraviolet rays are selectively irradiated on the photoresist P through an exposure mask M, and a developing process following the exposure process. The photoresist masks PR have opening patterns corresponding to groove portions W1 and the opening patterns are exposed. In the present embodiment, the groove portions W1 are located to correspond to the discharge cells S of FIG. 5.

Figure 6D:
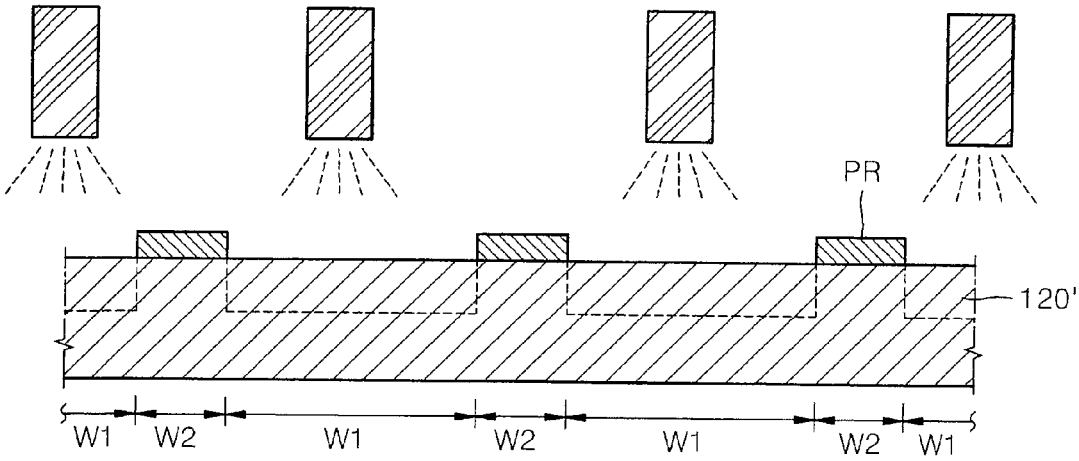
Figure 6E:
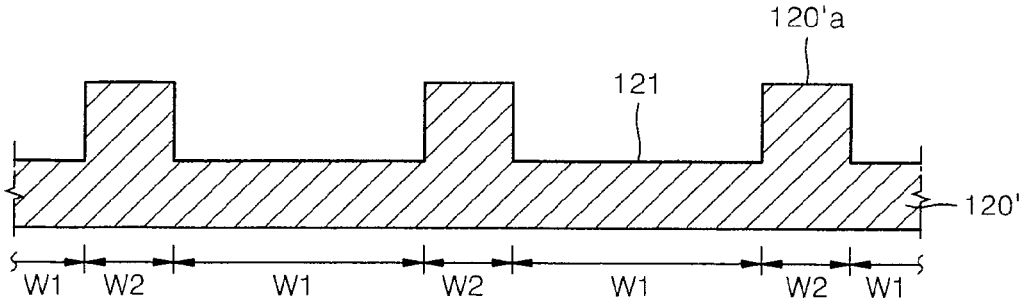

Then, referring to FIGS. 6D and 6E, the aluminum plate 120' is etched using the photoresist masks PR as anti-etching layers. Accordingly, the groove portions W1 are selectively etched and grooves 121 are formed. A difference in depth is formed between the groove portions W1 and in-between portions W2 located in between adjacent groove portions W1. Following the etching of the grooves 121, the photoresist masks PR are removed.

Figure 6F:
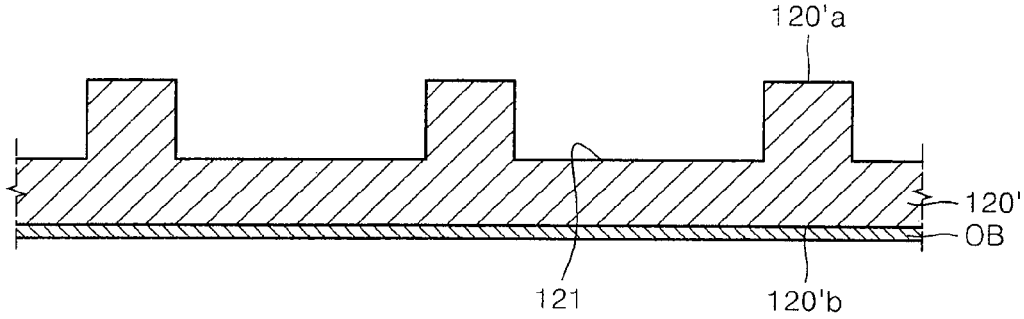

Then, referring to FIG. 6F, a surface, on which an insulation layer is formed by an oxidation process that is to be described later, is selected between a first surface 120'*a* and a second surface 120'*b* of the aluminum plate 120'. The oxidation layer 122 may be formed as the insulation layer on the first surface 120'*a* of the aluminum plate 120', which contacts the discharge cells S of FIG. 5. If only the first surface 120'*a* of the aluminum plate 120' is selectively oxidized, an anti-oxidation layer OB is formed on the second surface 120'*b* to block oxygen.

Figure 6G:
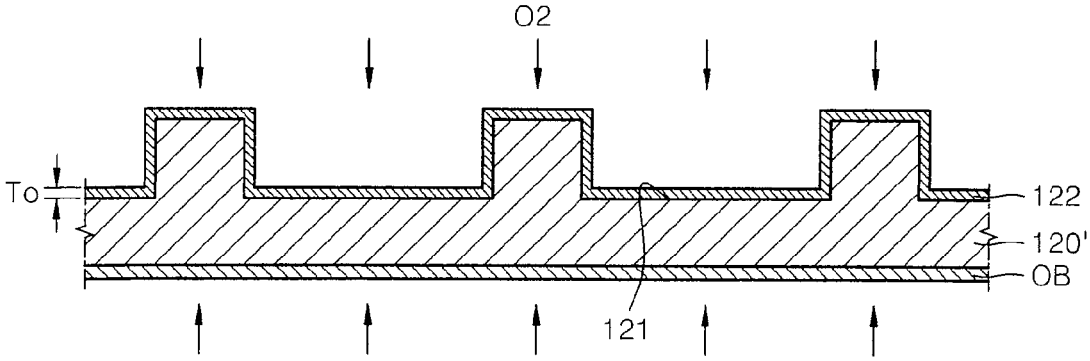

Then, referring to FIG. 6G, an anodizing process is performed to form the oxidation layer 122 on exposed surfaces of the aluminum plate 120' using the oxidation process. For the anodizing process, a direct current (DC) voltage is applied to the aluminum plate 120' that functions as the positive (+) pole. A catalyst composed of Pt, Ni or C functions as the negative (−) pole. The positive and negative poles are placed in an acid electrolytic solution such as $H_2SO_4$. An electrochemical reaction occurs that causes the oxidation layer 122 to be formed by oxidizing the aluminum plate 120' from the surface inward. In the present embodiment, a thickness To of the oxidation layer 122 may be optimized by controlling the anodizing process conditions such as the electrolytic solution, process time or the DC voltage. For example, the thickness To of the oxidation layer 122 may be controlled to be in a range of 1 μm-50 μm. The oxidation layer 122 is formed on the first surface 120'*a* of the aluminum plate 120'. The oxidation layer 122 may be formed of Alumina ($Al_2O_3$), which is a ceramic substance having insulating properties. In the present embodiment, the anti-oxidation layer OB prevents the forming of an oxidation layer on the second surface 120'*b* of the aluminum plate 120' by blocking oxygen from reaching this surface.

Figure 6H:
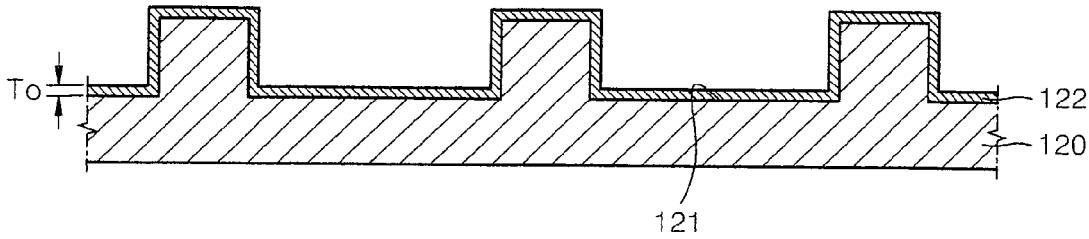

Then, referring to FIG. 6H, the rear substrate 120 is completed by removing the anti-oxidation layer OB.

Figure 6I:
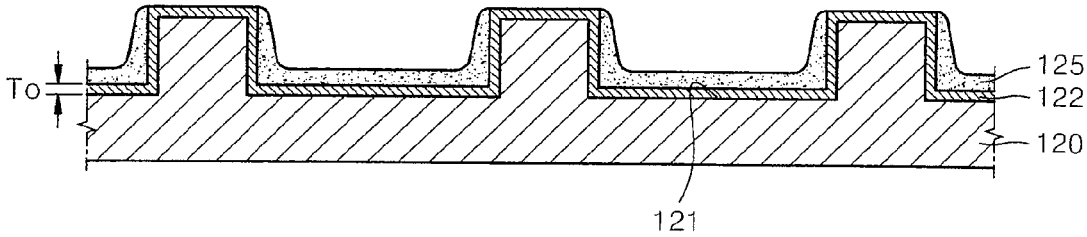

Then, referring to FIG. 6I, the fluorescent substances 125 are coated in grooves 121 defined by in-between regions of the grooves 121. A predetermined color R, G or B of the fluorescent substances 125 is coated in each of the grooves 121 that extend in one direction parallel to each other. For example, a screen printing method can be used in which predetermined fluorescent pastes are coated using a screen (not shown) having regular opening patterns. Alternative, a dispensing method can be used in which an injection nozzle included in a dispenser proceeds at a predetermined speed while injecting fluorescent pastes.

The plasma display apparatus according to an embodiment of the present invention may be provided through the processes described below with reference to FIG. 6J. The plasma display apparatus shown in FIG. 6J uses the rear substrate 120 formed by the above-described processes.

Figure 6J:
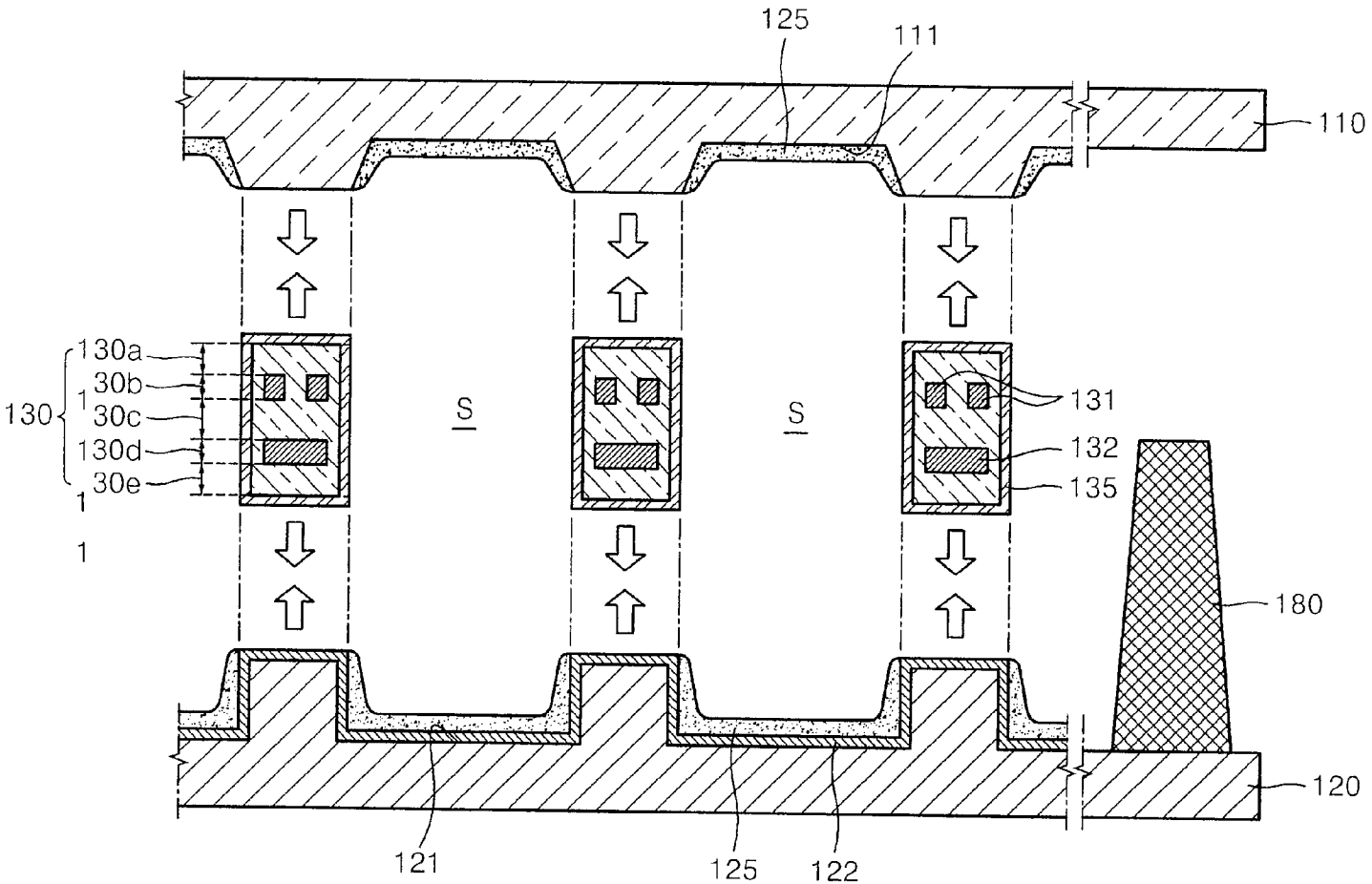

Referring to FIG. 6J, the barrier ribs 130 are formed by sequentially stacking first through fifth barrier-rib sheets 130*a*, 130*b*, 130*c*, 130*d*, 130*e* over one another. The first and second discharge electrodes 131, 132 are buried in the barrier ribs 130. In the embodiment shown, electrode patterns are formed in selected barrier-rib sheets, such as the second and fourth barrier-rib sheets 130*b*, 130*d*. For example, the first discharge electrodes 131 are patterned in the second barrier-rib sheet 130*b* and the second discharge electrodes 132 are patterned in the fourth barrier-rib sheet 130*d*. The other barrier-rib sheets such as the first, third and fifth barrier-rib sheets 131*a*, 130*c*, 130*e* may be formed of substantially similar dielectric sheets.

After the stacking of the first through fifth barrier-rib sheets 130*a* through 130*e*, the first through fifth barrier-rib sheets 130*a* through 130*e* are fused and integrated with each other by a baking process at a high temperature. Then, the integrated first through fifth barrier-rib sheets 130*a* through 130*e* are punched in order to form opening patterns at regular intervals that form walls of the discharge cells S. MgO films, which function as protective layers 135, are formed on the sidewalls of the discharge cells S by a sputtering method. For the convenience of explanation, it is assumed that the barrier ribs 130 having a sufficient height are formed by stacking the first through fifth barrier-rib sheets 130*a* through 130*e* as in the current embodiment of the present invention. However, in different embodiments, additional sheets may be included for forming the barrier-ribs in order to provide sufficient space inside the discharge cells S.

The front substrate 110 may be formed by forming the grooves 111 at predetermined positions and coating the R, G and B fluorescent substances 125 on the grooves 111. Finally, the front and rear substrates 110, 120 are located facing each other including the barrier ribs 130 therebetween, and then are combined by a frit sealing material 180 coated along the rim of the rear substrate 120. As described above, the plasma display apparatus according to the embodiments of the present invention is completed. Subsequently, the driving circuit unit 160 including the driving ICs and circuit boards, which generate and transfer a driving signal to be applied to the first and second discharge electrodes 131, 132, can be mounted on the rear substrate 120.

Figure 7:
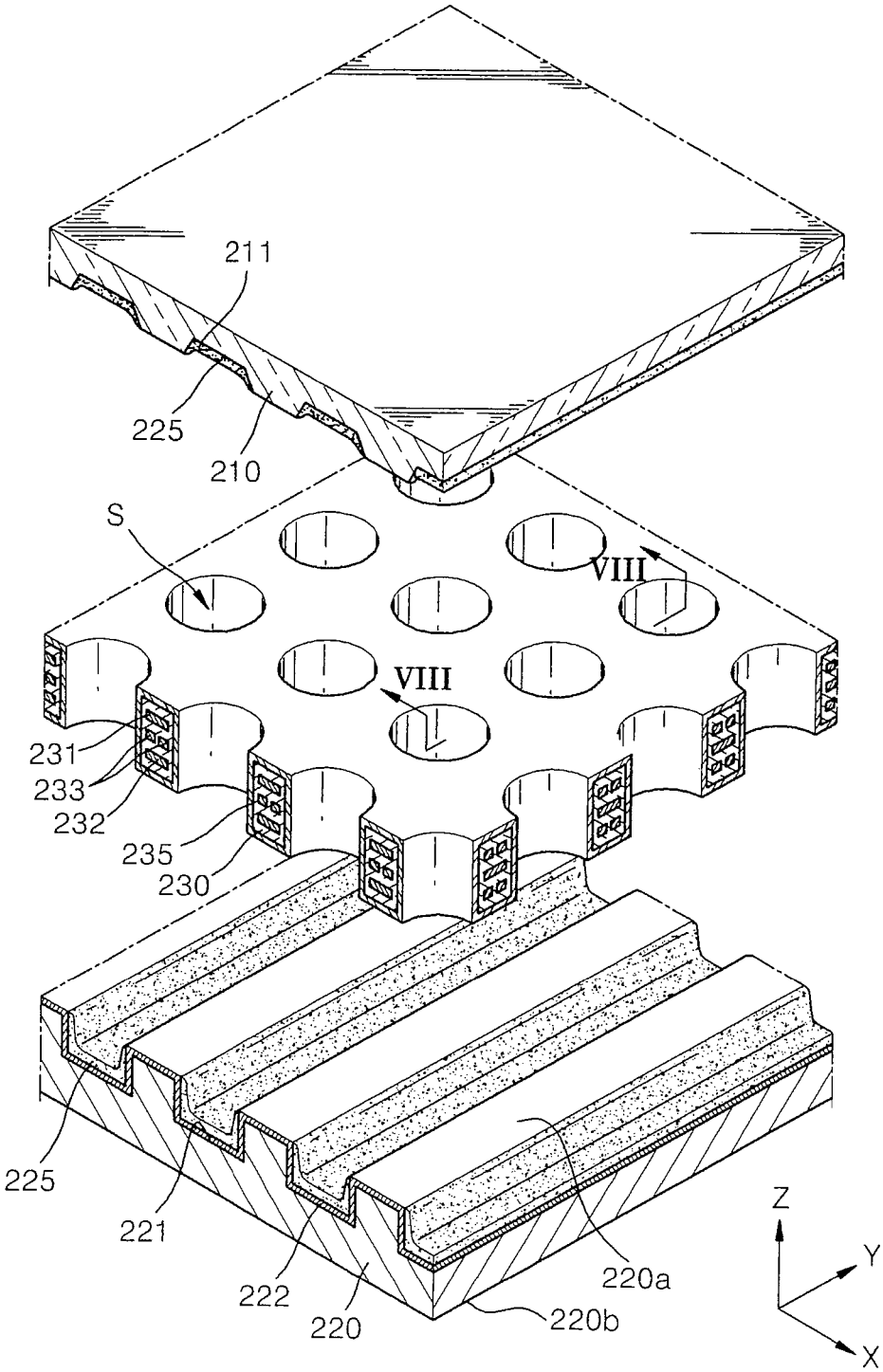
FIG. 7 is an exploded perspective view of a plasma display apparatus according to another embodiment of the present invention.
Figure 8:
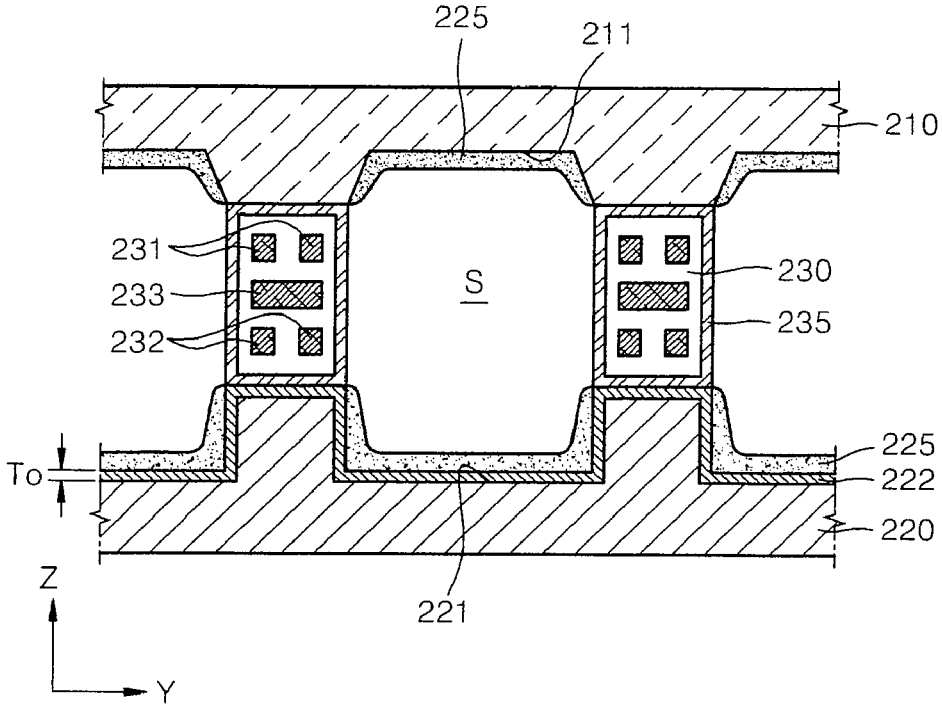
FIG. 8 is a longitudinal cross-sectional view of the plasma display apparatus cut along a line VIII-VIII of FIG. 7, according to an embodiment of the present invention.
Figure 9:
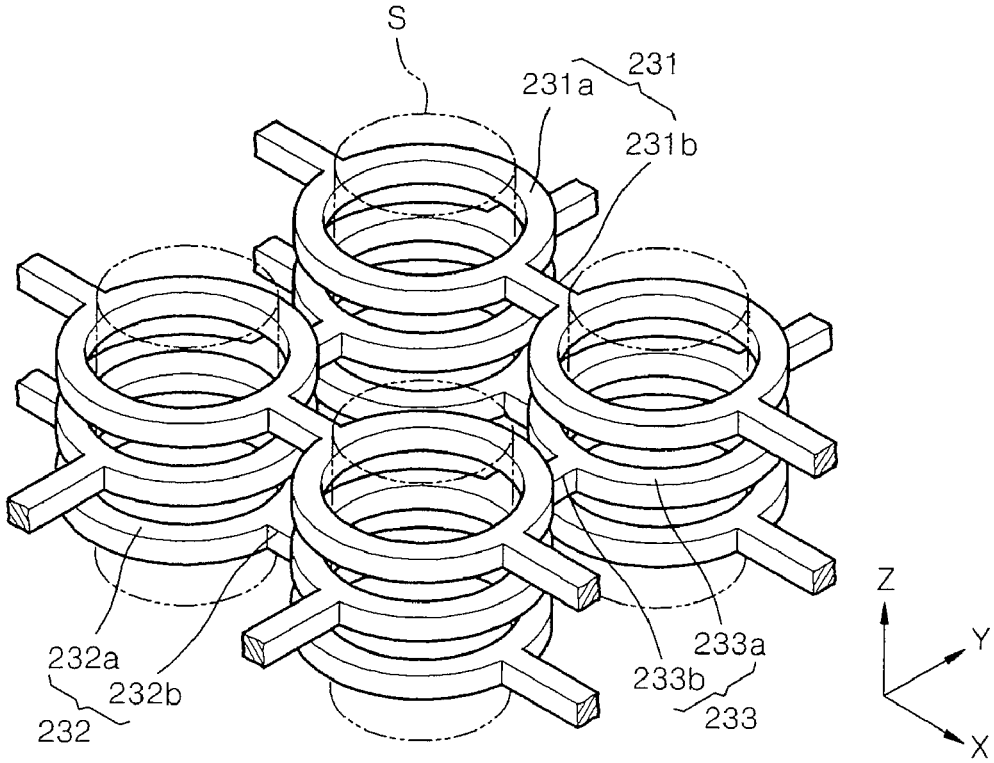
FIG. 9 is a perspective view illustrating a configuration of electrodes of the plasma display apparatus of FIG. 7, according to an embodiment of the present invention.

FIG. 7 is an exploded perspective view of a plasma display apparatus according to another embodiment of the present invention. FIG. 8 is a longitudinal cross-sectional view of the plasma display apparatus cut along a line VIII-VIII of FIG. 7. FIG. 9 is a perspective view illustrating a configuration of electrodes of FIG. 7.

Similar to the plasma display apparatus according to the embodiment of the present invention that is illustrated in FIG. 2, the plasma display apparatus according to the current embodiment of the present invention includes front and rear substrates 210, 220 located facing each other and barrier ribs 230 that are located between the front and rear substrates 210, 220, and define a plurality of discharge cells S. The front and rear substrates 210, 220 may be set apart at a predetermined distance. The rear substrate 220 is formed by forming first grooves 221 parallel to one another on a first surface 220*a* of the rear substrate 220. The rear substrate 220 may be an aluminum plate. An oxidation layer 222 is formed at least on the first surface 220*a* of the rear substrate 220 by an oxidation process such as an anodizing process. Accordingly, the rear substrate 220 is chassis-base-integrated and supports the front substrate 210, the barrier ribs 230 and a driving circuit unit (not shown) on the first surface 220*a* and a second surface 220*b* of the rear substrate 220 and dissipates heat of these components. According to the embodiment of the present invention shown in FIG. 7, first through third discharge electrodes 231, 232, 233 are included in the plasma display apparatus. Referring to FIG. 9, the first through third discharge electrodes 231, 232, 233 surround the discharge cells S located in rows. The first, second and third discharge electrodes may extend along predetermined directions. In the present embodiment, the first through third discharge electrodes 231 through 233 surround the discharge cells S and are located at different elevations along heights of the discharge cells S. The first through third discharge electrodes 231 through 233 include discharge portions 231*a*, 232*a*, 233*a*, which surround the discharge cells S, and conduction portions 231*b*, 232*b*, 233*b*, which electrically connect the adjacent discharge portions 231*a*, 232*a*, 233*a* to each other. In the present embodiment, the first and second discharge electrodes 231, 232 are used to generate a display discharge in the discharge cells S and extend parallel to each other in an x-direction of the drawing. The display discharge is generated in the discharge cells S by applying alternating current pulses, which generate discharge between the first and second discharge electrodes 231 and 232.

The third discharge electrodes 233 are located between the first and second discharge electrodes 231, 232, and extend, for example, in a y-direction crossing at right angles the direction of the first and second discharge electrodes 231 and 232. The third discharge electrodes 233 generate an address discharge together with the first discharge electrodes 231 or the second discharge electrodes 232 in order to select the discharge cells S. In the present embodiment, the address discharge is a kind of preliminary discharge to facilitate the display discharge to be generated appropriately. In consideration of emission efficiency, additional grooves 211 in which fluorescent substances 225 are coated can also be formed on the front substrate 210 according to the current embodiment of the present invention. Protective layers 235 may be formed on the sidewalls of the barrier ribs 230 that define the discharge cells S.

As described above, by forming a rear substrate from a conductive metallic substance such as aluminum and forming an oxidation layer able to withstand a high voltage on at least one surface of the rear substrate so as to provide an insulated discharge environment, the rear substrate that integrates a chassis base according to the embodiments of the invention performs functions of a glass substrate and a chassis base at the same time. As a result, the number of required components is reduced. In particular, by not employing a two-sided tape for combining the glass substrate and the chassis base and a heat-dissipation sheet for heat transference, the number of required components is further reduced. Also, by omitting additional assembling processes to press-combine the glass substrate and the chassis base, assembling processes are also reduced.

Furthermore, dissipating heat generated in the discharge cells is accomplished and improved by removing the glass substrate, which has low heat dissipation capabilities.

While the present invention has been particularly shown and described with reference to certain exemplary embodiments, it will be understood that various changes in form and details may be made therein without departing from the spirit and scope of the invention as defined by the appended claims and their equivalents.

What is claimed is:

1. A plasma display apparatus comprising:

a front substrate;

a substantially aluminum rear substrate, the rear substrate including a first surface facing the front substrate, rear substrate grooves being on the first surface, and a first surface oxidation layer on the first surface, the first surface oxidation layer including Alumina ($Al_2O_3$);

barrier ribs between the front substrate and the rear substrate, the barrier ribs forming discharge cells corresponding to the rear substrate grooves;

discharge electrodes in the barrier ribs, the discharge electrodes surrounding at least portions of the discharge cells and being separated from one another;

fluorescent substances in the rear substrate grooves; and a discharge gas in the discharge cells.

2. The plasma display apparatus of claim 1, wherein the rear substrate is formed by oxidizing an aluminum plate including the rear substrate grooves.

3. The plasma display apparatus of claim 1, wherein the grooves are in stripes corresponding to the discharge cells arranged in rows.

4. The plasma display apparatus of claim 1, wherein the rear substrate includes a second surface opposite the first surface with a second oxidation layer on the second surface.

5. The plasma display apparatus of claim 4, wherein the first oxidation layer is thicker than the second oxidation layer.

6. The plasma display apparatus of claim 1, wherein the rear substrate includes a second surface opposite the first surface, and wherein a driving circuit unit for generating a driving signal and transferring the driving signal to the discharge electrodes is mounted on the second surface.

7. The plasma display apparatus of claim 1, wherein the discharge electrodes include first discharge electrodes and second discharge electrodes surrounding the discharge cells at different levels between the front substrate and the rear substrate, the first discharge electrodes and the second discharge electrodes extending in directions crossing each other.

8. The plasma display apparatus of claim 1, wherein the discharge electrodes include:

first discharge electrodes and second discharge electrodes extending parallel to each other, the first discharge electrodes and the second discharge electrodes each surrounding the discharge cells at different levels between the front substrate and the rear substrate; and third discharge electrodes extending along a direction crossing a common direction of the first discharge electrodes and the second discharge electrodes, the third discharge electrodes surrounding the discharge cells between the first discharge electrodes and the second discharge electrodes.

9. The plasma display apparatus of claim 8, wherein the third discharge electrodes, together with either the first discharge electrodes or the second discharge electrodes, generate an address discharge for selecting the discharge cells.

10. The plasma display apparatus of claim 1, wherein protective layers cover the barrier ribs forming sidewalls of the discharge cells.

11. The plasma display apparatus of claim 1, wherein front substrate grooves are on a surface of the front substrate facing the rear substrate and additional fluorescent substances are located in the front substrate grooves, the front substrate grooves corresponding to the discharge cells.

12. A method of manufacturing a plasma display apparatus comprising:

preparing a front substrate;

preparing a rear substrate;

stacking dielectric sheets having electrode patterns on one another for forming barrier ribs, the barrier ribs for burying discharge electrodes; and frit sealing the front substrate and the rear substrate to combine the front substrate and the rear substrate facing each other while locating the barrier ribs between the front substrate and the rear substrate, wherein the preparing of the rear substrate includes:

preparing an aluminum plate;

forming photoresist masks on a first surface of the aluminum plate, the photoresist mask exposing regions on the first surface to yield exposed regions;

forming grooves in the first surface by selectively etching the exposed regions;

forming an anti-oxidation layer covering a second surface of the aluminum plate, the second surface opposite the first surface;

anodizing the first surface for forming an oxidation layer on the first surface;

removing the anti-oxidation layer; and coating fluorescent substances in the grooves.

13. The method of claim 12, wherein the stacking dielectric sheets includes:

providing stacked dielectric sheets including at least one dielectric sheet having electrode patterns;

baking the stacked dielectric sheets to form integrated dielectric sheets;

punching openings in the integrated dielectric sheets, the openings for forming discharge cells; and forming protective layers on sidewalls of the discharge cells.

14. The method of claim 12, further comprising mounting a driving circuit unit on the second surface, the driving circuit unit for generating a driving signal and transferring the driving signal to the discharge electrodes.

* * * * *